US007067042B2

(12) United States Patent
Moser et al.

(10) Patent No.: US 7,067,042 B2
(45) Date of Patent: Jun. 27, 2006

(54) TWIN WIRE FORMER

(75) Inventors: Johann Moser, Heidenheim (DE); Volker Schmidt-Rohr, Heidenheim (DE)

(73) Assignee: Voith Paper Patent GmbH, Heindenheim (DE)

( * ) Notice: Subject to any disclaimer, the term of this patent is extended or adjusted under 35 U.S.C. 154(b) by 0 days.

(21) Appl. No.: 10/659,471

(22) Filed: Sep. 10, 2003

(65) Prior Publication Data

US 2004/0045691 A1 Mar. 11, 2004

Related U.S. Application Data

(63) Continuation of application No. PCT/EP02/02067, filed on Feb. 27, 2002.

(30) Foreign Application Priority Data

Mar. 13, 2001 (DE) ..... 201 04 380 U

(51) Int. Cl.
*D21F 1/00* (2006.01)

(52) U.S. Cl. ..... 162/300; 162/301; 162/305; 162/306; 162/363; 162/203

(58) Field of Classification Search ..... 162/301, 162/306, 363, DIG. 7, 300, 203
See application file for complete search history.

(56) References Cited

U.S. PATENT DOCUMENTS

| | | | | |
|---|---|---|---|---|
| 1,599,376 | A * | 9/1926 | Smith | 162/301 |
| 4,100,018 | A * | 7/1978 | Wahren et al. | 162/203 |
| 5,395,484 | A | 3/1995 | Odell et al. | 162/203 |

FOREIGN PATENT DOCUMENTS

| | | |
|---|---|---|
| DE | 40 14 403 | 11/1991 |
| EP | 0 369 296 | 11/1989 |
| EP | 0 454 989 | 3/1991 |
| EP | 0 471 469 | 7/1991 |
| WO | WO 97/08382 | 3/1997 |

* cited by examiner

*Primary Examiner*—Mark Halpern
(74) *Attorney, Agent, or Firm*—Taylor & Aust, P.C.

(57) ABSTRACT

The present invention relates to a twin wire former in a machine for the production of a fiber web, especially a paper or cardboard web from at least one fiber stock suspension, including a vertical twin wire segment having two wires running over a peripheral area of a turning element, especially a guide roll whose surface is preferably not equipped with suction and is smooth or substantially smooth; and in that at least one separation element, such as a transfer suction box is provided indirectly or immediately following the guide roll that separates the top wire from the bottom wire on which the fibrous web is supported.

10 Claims, 2 Drawing Sheets

TWIN WIRE FORMER

This application is a CON of PCT/EP02/02067 filed on 27 Feb., 2002.

BACKGROUND OF THE INVENTION

1. Field of the Invention

The present invention relates to a twin wire former in a machine for the production of a fiber web, and, more particularly, to a twin wire former for the production of a paper or cardboard web from at least one fiber stock suspension.

2. Description of the Related Art

A twin wire former, generally also referred to as a vertical former is known, for example, from the Voith German patent application DE 40 14 403 A1 (PB06623 DE) and the Voith European patent application EP 0 454 989 A1 (PB06623 EP). At the exit of the vertical forming section, that includes forming elements, the twin wire runs over an open forming roll such as a suction couch roll. The function of this suction couch roll is to further increase the dry content in the forming fibrous web.

A disadvantage of utilizing a forming roll, that is configured as a suction couch roll, is that the initial investment, as well as the operating costs, typically energy costs for its drive and for an air supply are expensive. Also this construction is maintenance intensive at a level that is above average. Additionally, the suction couch roll must generally also be equipped with special cleaning systems and it exhibits an increased noise level during operation. The suction couch roll is a heavy sub-assembly for the frame. With wide machine widths the suction couch roll is a deflection prone sub-assembly for the wire segment, and is a critical cause for suction roll shadow marks that lower fiber web quality.

What is needed in the art is a twin wire former with improved drying characteristics.

SUMMARY OF THE INVENTION

In accordance with an embodiment of the present invention, a twin wire former includes a vertical twin wire segment. At the top end of the vertical twin wire segment, viewed in the direction of wire travel, the two wires run over a peripheral area of a turning element. The turning element may be a guide roll whose surface is preferably not equipped with suction and is smooth or approximately smooth. Additionally, at least one separation element, in the form of a transfer suction box is positioned indirectly or immediately following the guide roll, viewed in the direction of wire travel, that separates the top wire from the bottom wire on which the fiber web is supported.

By utilizing a turning element, especially a guide roll, in place of a suction couch roll and at least one transfer suction box for the separation of the wires, the investment costs, as well as the energy costs are considerably reduced. Also, the maintenance requirements for a turning element, especially a guide roll, are considerably lower than those for a suction couch roll. In addition, a turning element, in the form of a guide roll can be constructed to have a higher deflection resistance, reducing the stress on the frame, as well as risk to the wire segment. Moreover, when a turning element, especially a guide roll whose surface is preferably not equipped with suction and is smooth or approximately smooth, is utilized only a small risk remains of deteriorating the quality of the fiber web, particularly the occurrence of suction roll shadow marks.

Furthermore, a reliable separation of the top wire from the bottom wire, on which the fiber web is supported, is assured through the utilization of a transfer suction box. On the other hand the dry content of the forming fiber web is further increased.

Preferably, the transfer suction box is supplied with a partial vacuum of 10 kPa to 50 kPa, preferably 15 kPa to 40 kPa through an adjustable vacuum source. This provides positive separation as well as drying results.

So that marks in the forming fiber web, and separation problems in the forming fiber web are avoided, the transfer suction box should extend preferably across the entire width of the fiber web and is equipped with at least three, preferably six slots, each having a slot width of less than 20 mm, preferably less than 15 mm. To further increase the dry content in the forming fiber web, at least one additional flat suction box is provided, preferably between the guide roll and the transfer suction box and/or following the transfer suction box, viewed in the direction of wire travel.

The absolute construction height of the twin wire former can be reduced, if at least one additional guide roll, with preferably a smaller roll diameter, is provided between the guide roll and the transfer suction box. In addition, it is advantageous, if the twin wire segment, following the guide roll, drops off in a downward direction at an angle of 0° to 60°, preferably of 15° to 45°.

In order to return the wire water, that accumulates in the area of the turning element, safely, quickly and cheaply back to a corresponding wire water tank, a wire water removal arrangement, including a collection and return profile, a turning profile and a drainage device having a discharge pipe is associated with the guide roll.

It is understood that the aforementioned characteristics of the invention that will also be explained below in further detail are applicable not only in the cited combinations, but also in other combination, or individually, without leaving the scope of the current invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
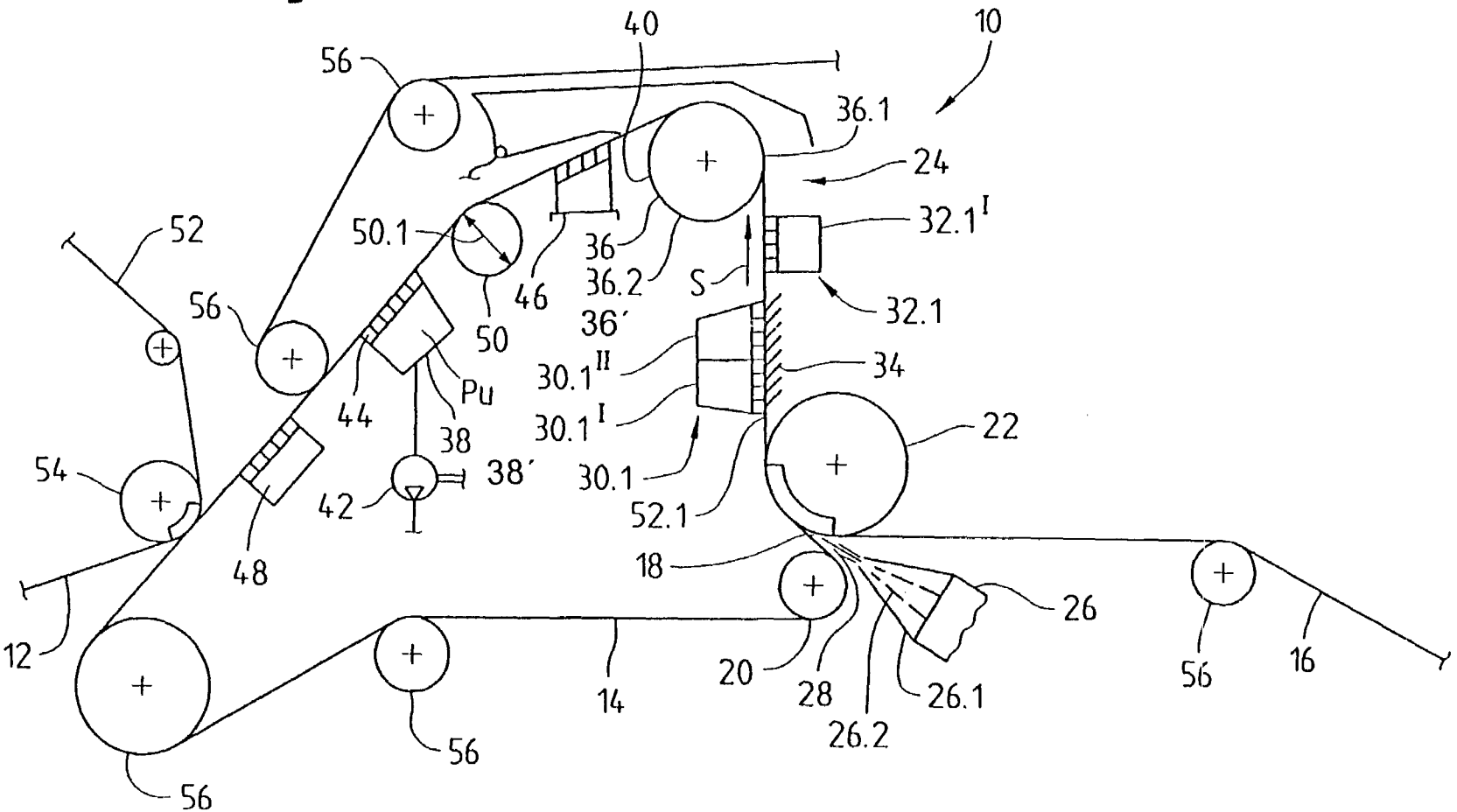
FIG. 1 is a schematic illustration of one embodiment of the twin wire former of the present invention.

Referring now to the drawings, and more particularly to FIG. 1 there is illustrated an embodiment of the twin wire former 10 of the present invention in a machine for the production of a fiber web 12, especially a paper or cardboard web. Twin wire former 10 includes two revolving continuous wires 14 and 16 that converge, thereby forming a stock inlet gap 18. In the area of stock inlet gap 18, bottom wire 14 is carried over a breast roll 20, and top wire 16 over a suction-equipped forming roll 22.

Fiber stock suspension 28 is supplied from below by way of headbox 26 into stock inlet gap 18 that is located generally below substantially vertical twin wire segment 24. Alternatively, headbox 26 can be equipped with separation elements 26.2, also known as plates 26.2, in its headbox nozzle 26.1, which are indicated only by broken lines.

Within twin wire segment 24 that connects in an upward direction from stock inlet gap 18, wires 14 and 16 pass forming unit 30.1 and dewatering device 32.1 that are located following each other, viewed in direction S. Unit 30.1 and device 32.1 remove wire water 52.1 from fiber stock suspension 28 between wires 14 and 16, through the respective wires 14 and 16, by way of at least one vacuum source (not shown) that provides a partial vacuum. Forming unit 30.1 is located in the wire loop of bottom wire 14 and includes two forming zones 30.1$^{I}$ and 30.1$^{II}$. Dewatering device 32.1 is located in the wire loop of top wire 16 and includes a dewatering zone 32.1$^{I}$. The respectively stated number of zones is purely exemplary and the respective number can deviate from the cited values. Units 30.1 and 32.1 may have a straight, a curved, or a combination of a straight and curved surface. Forming unit 30.1 illustrated in the drawing has a curved surface.

A number of forming strips 34 are located opposite forming unit 30.1. Forming strips 34 can be mounted flexibly and/or in a stationary manner. Additionally, forming strips 34 can be mounted such that their position relative to their wire 16 is adjustable, for example by way of sliding or pivoting.

At the upper end of vertical twin wire segment 24, viewed in direction S, wires 14 and 16 run over peripheral area 36.1 of turning element 36'. Guide roll 36 has a surface 36.2 that is preferably not equipped with suction and is smooth or substantially smooth. Separation element 38', which includes transfer suction box 38, is provided indirectly or immediately after guide roll 36, viewed in direction S. Separation element 38' separates wire 16 from the wire 14 on which fiber web 12 is supported.

Transfer suction box 38 is supplied with a partial vacuum $p_u$ of 10 kPa to 50 kPa, preferably of 15 kPa to 40 kPa, through an adjustable vacuum source 42. In addition it is equipped with at least three, preferably six slots, each having a slot width of less than 20 mm, preferably less than 15 mm and extends preferably across the entire width of fiber web 12. At least one flat suction box 46 or 48, is additionally provided between guide roll 36 and transfer suction box 38 and/or following transfer suction box 38.

At least one additional guide roll 50 with a smaller roll diameter 50.1 than guide roll 36 is provided between guide roll 36 and transfer suction box 38. After guide roll 36, twin wire segment 24, viewed in direction S, drops off in a downward direction at an angle of 0° to 60°, preferably of 15° to 45°.

Fiber web 12, that is carried by bottom wire 14, is removed from bottom wire 14, after flat suction box 48 by felt 52 at pick-up roll 54 and is transported into the press section of a machine, that is not illustrated here, for the production of a fiber web 12, especially a paper or cardboard web. Subsequently, wires 14 and 16 run over several turning rollers 56 and non-illustrated wire tension rolls, back into the area of stock inlet gap 18. In the course of routing the two wires 14 or 16, they can also be respectively routed through or past at least one wire cleaning unit for wires 14 and 16, that is known in the state of the art and that is not illustrated here.

Figure 2:
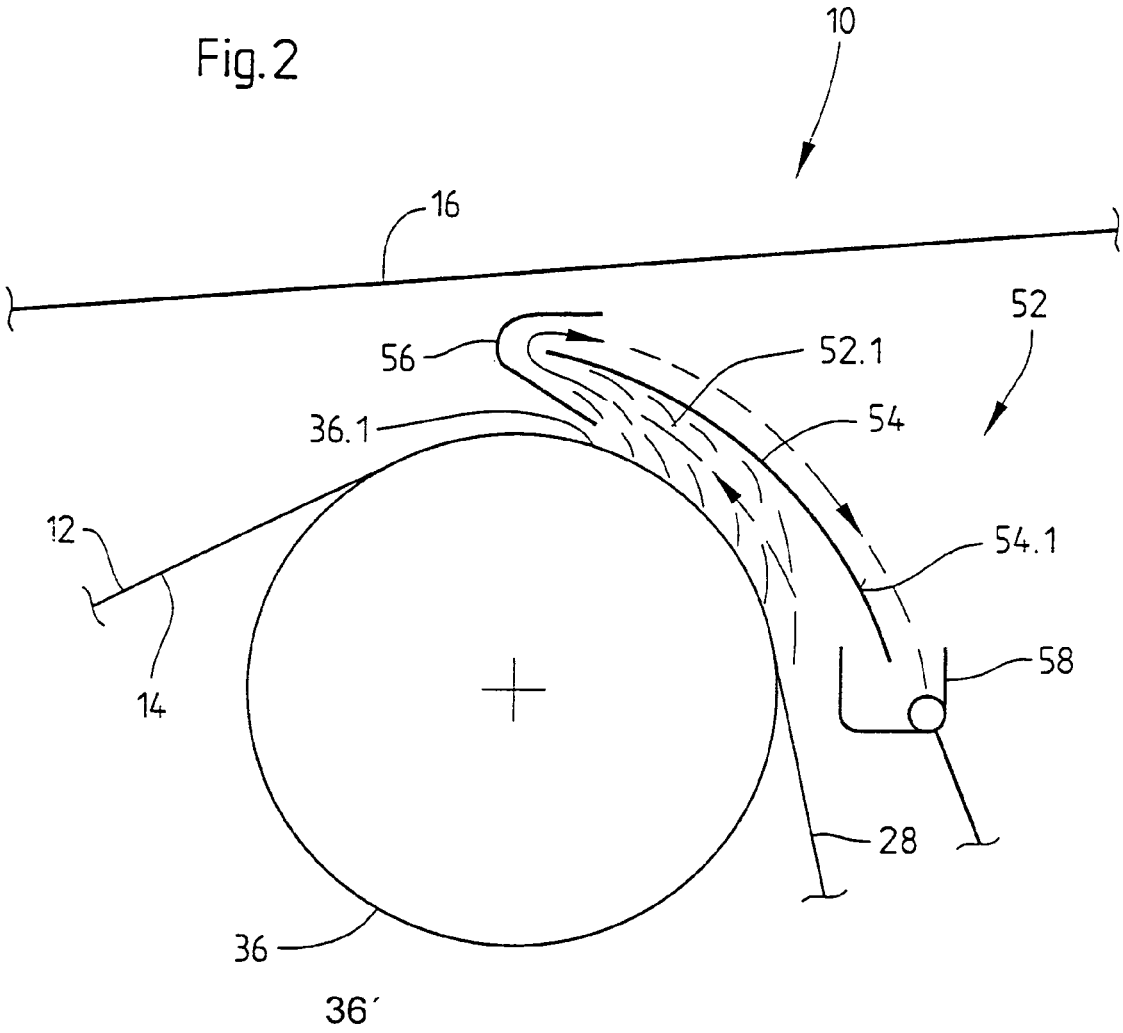
FIG. 2 is a schematic partial view of an another embodiment of the twin wire former of the present invention.

Now, additionally referring FIG. 2, there is shown an additional embodiment of twin wire former 10 of the present invention for the production of fiber web 12, especially a paper or cardboard web, from fiber stock suspension 28. Proximate to guide roll 36, there is a wire water removal arrangement 52, including a collection and return profile 54, a turning profile 56 and a drainage device 58 including an indicated discharge pipe. Wire water 52.1 travels in the general direction of the arrows as it releases from wires 14 and 16, and fiber stock suspension 28 is collected at collection and return profile 54 that is located partially along peripheral area 36.1 of guide roll 36. Wire water 52.1 is transported along collection and return profile 54 due to the momentum of wire water 52.1. Subsequently wire water 52.1 is re-routed at turning profile 56 so that it flows on back 54.1 of wire water 52.1 collection and return profile 54 toward drainage device 58. From there wire water 52.1 is transported into a wire water tank that is not illustrated here, by way of a pipe.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

| Component Identification | |
|---|---|
| 10 | Twin wire former |
| 12 | Fiber web |
| 14 | Wire ("bottom wire") |
| 16 | Wire ("Top wire") |
| 18 | Stock inlet gap |
| 20 | Breast roll |
| 22 | Forming roll |
| 24 | Twin wire segment |
| 26 | Head box |
| 26.1 | Head box nozzle |
| 26.2 | Separation element (plate) |
| 28 | Fiber stock suspension |
| 30.1 | Forming unit |
| 30.1$^{I}$, 30.1$^{II}$ | Forming zones |
| 32.1 | Dewatering unit |
| 32.1$^{I}$ | Dewatering zone |
| 34 | Forming strip |
| 36' | Turning element |
| 36, 50 | Guide rolls |
| 36.1 | Peripheral area |
| 36.2 | Surface |
| 38' | Separation element |
| 38 | Transfer suction box |
| 40 | Shrink cover |
| 42 | Vacuum source |
| 44 | Slot |
| 46, 48 | Flat suction boxes |
| 50.1 | Roll diameter |
| 52 | Wire water removal arrangement |
| 52.1 | Wire water |
| 54 | Collection and return profile |
| 54.1 | Back |
| 56 | Turning profile |
| 58 | Drainage device |
| Pu | partial vacuum |
| S | Direction of wire water flow (arrow) |
| α | angle |

What is claimed is:

1. A twin wire former in a machine for the production of a fiber web, comprising:

two revolving continuous wires including a top wire and a bottom wire, said top wire and said bottom wire converging to thereby form a stock inlet gap, said top wire and said bottom wire being proximate to each other over a substantially vertical segment, said top wire and said bottom wire having a direction of travel;

a headbox from which a fiber stock suspension flows to said stock inlet gap;

at least one forming unit, said top wire and said bottom wire being proximate thereto;

at least one dewatering unit, said top wire and said bottom wire being proximate thereto, said at least one dewatering unit following said at least one forming unit in said direction of travel;

a turning element proximate an upper portion of said vertical segment, said turning element having a peripheral area over which said two revolving continuous wires are turned, said turning element being substantially smooth; and at least one separation element following said turning element in said direction of travel, said at least one separation element separating said top wire from said bottom wire, said at least one separation element including a transfer suction box having at least three slots, each said slot width being less than approximately 20 mm.

2. The twin wire former of claim 1, wherein an at least one separation element includes a transfer suction box supplied with a partial vacuum $p_u$ of approximately 10 kPa to approximately 50 kPa by way of an adjustable vacuum source.

3. The twin wire former of claim 2, wherein said partial vacuum $p_u$ is between approximately 15 kPa and approximately 40 kPa.

4. The twin wire former of claim 1, wherein said slot width is less than approximately 15 mm.

5. The twin wire former of claim 1, wherein said at least one separation element extends substantially across a width of the fiber web.

6. The twin wire former of claim 1, wherein said turning element is a guide roll, said two revolving continuous wires are downwardly angled at from approximately 0° to approximately 60° from horizontal in said direction of travel.

7. The twin wire former of claim 6, wherein said two revolving continuous wires are downwardly angled at from approximately 15° to approximately 45° from horizontal in said direction of travel.

8. A twin wire former in a machine for the production of a fiber web, comprising:

two revolving continuous wires including a top wire and a bottom wire, said top wire and said bottom wire converging to thereby form a stock inlet gap, said top wire and said bottom wire being proximate to each other over a substantially vertical segment, said top wire and said bottom wire having a direction of travel;

a headbox from which a fiber stock suspension flows to said stock inlet gap;

at least one forming unit, said top wire and said bottom wire being proximate thereto;

at least one dewatering unit, said top wire and said bottom wire being proximate thereto, said at least one dewatering unit following said at least one forming unit in said direction of travel;

a turning element proximate an upper portion of said vertical segment, said turning element having a peripheral area over which said two revolving continuous wires are turned, said turning element being substantially smooth;

at least one separation element following said turning element in said direction of travel, said at least one separation element separating said top wire from said bottom wire; and at least one flat suction box, said turning element being a guide roll, said at least one separation element being a transfer suction box, said at least one flat suction box being located between said guide roll and said transfer suction box.

9. The twin wire former of claim 8, further comprising at least one additional guide roll with a smaller diameter than said guide roll, said at least one additional guide roll being located between said guide roll and said transfer suction box.

10. The twin wire former of claim 8, wherein said at least one flat suction box includes a first suction box and a second suction box, said first suction box being located between said guide roll and said transfer suction box, said second suction box being located after said transfer suction box in said direction of travel.

* * * * *